US011290816B2

(12) United States Patent
Huang

(10) Patent No.: US 11,290,816 B2
(45) Date of Patent: Mar. 29, 2022

(54) LOUDSPEAKER AND AUDIO VIDEO DEVICE

(71) Applicant: Shenzhen Luxshare Acoustics Technology Ltd., Guangdong (CN)

(72) Inventor: Jiin Tarng Huang, Shenzhen (CN)

(73) Assignee: SHENZHEN LUXSHARE ACOUSTICS TECHNOLOGY LTD., Guangdong (CN)

( * ) Notice: Subject to any disclaimer, the term of this patent is extended or adjusted under 35 U.S.C. 154(b) by 0 days.

(21) Appl. No.: 17/147,191

(22) Filed: Jan. 12, 2021

(65) Prior Publication Data

US 2021/0329380 A1 Oct. 21, 2021

(30) Foreign Application Priority Data

Apr. 20, 2020 (CN) ..... 202010311990.6

(51) Int. Cl.

| | |
|---|---|
| ***H04R 5/02*** | (2006.01) |
| ***G09F 27/00*** | (2006.01) |
| ***H04R 9/06*** | (2006.01) |
| ***H04R 9/02*** | (2006.01) |
| ***H04R 7/04*** | (2006.01) |
| ***H04R 7/06*** | (2006.01) |

(52) U.S. Cl.

CPC ..... *H04R 5/02* (2013.01); *G09F 27/00* (2013.01); *H04R 7/04* (2013.01); *H04R 7/06* (2013.01); *H04R 9/02* (2013.01); *H04R 9/06* (2013.01)

(58) Field of Classification Search

CPC ... H04R 5/02; H04R 7/04; H04R 9/02; H04R 9/06; G09F 27/00

See application file for complete search history.

(56) References Cited

U.S. PATENT DOCUMENTS

2015/0304747 A1* 10/2015 Wang ..... H04R 1/02 381/345
2016/0119718 A1* 4/2016 Yang ..... H04R 1/28 381/351

(Continued)

FOREIGN PATENT DOCUMENTS

| | | |
|---|---|---|
| CN | 201499295 U | 6/2010 |
| CN | 203675306 U | 6/2014 |
| CN | 204559858 U | 8/2015 |

(Continued)

*Primary Examiner* — Andrew L Sniezek

(74) *Attorney, Agent, or Firm* — Birch, Stewart, Kolasch & Birch, LLP

(57) ABSTRACT

Provided are a loudspeaker and an audio video device. The loudspeaker includes a loudspeaker box and a drive unit. The loudspeaker box includes a middle frame, a first diaphragm and a second diaphragm. The first diaphragm and the second diaphragm are respectively disposed at the two ends of the middle frame, the first diaphragm, the second diaphragm and the middle frame are enclosed to form a sound cavity. The drive unit is disposed in the sound cavity. The drive unit comprises a U-iron, a magnet, a magnetic conductive plate and a voice coil. The magnet is disposed on the U-iron, the magnetic conductive plate is disposed on the magnet, and the voice coil is sleeved on the magnet and the magnetic conductive plate. The U-iron is disposed on the first diaphragm, and the voice coil is disposed on the second diaphragm.

17 Claims, 3 Drawing Sheets

(56) References Cited

U.S. PATENT DOCUMENTS

| | | | | |
|---|---|---|---|---|
| 2016/0205479 | A1 | 7/2016 | Tomar | |
| 2019/0230442 | A1 * | 7/2019 | Xiao | H04R 9/025 |

FOREIGN PATENT DOCUMENTS

| | | | |
|---|---|---|---|
| CN | 204836570 | U | 12/2015 |
| CN | 205946144 | U | 2/2017 |
| CN | 107889034 | A | 4/2018 |
| CN | 207475849 | U | 6/2018 |
| CN | 109951773 | A | 6/2019 |
| CN | 110572749 | A | 12/2019 |

* cited by examiner

LOUDSPEAKER AND AUDIO VIDEO DEVICE

CROSS-REFERENCE TO RELATED APPLICATION

This application claims priority to Chinese Patent Application No. 202010311990.6 filed Apr. 20, 2020, the disclosure of which is incorporated herein by reference in its entirety.

TECHNICAL FIELD

The present disclosure relates to the technical field of loudspeakers and, in particular, to a loudspeaker and an audio video device.

BACKGROUND

A loudspeaker is an electroacoustic conversion device, which is applied to an audio video device such as a mobile phone, a tablet, a television, or a notebook computer.

The existing loudspeaker generally includes a structure using a film cone with a wavy positioning support chip. In such loudspeaker, a center hole is opened in the center of the film cone, the wavy positioning support chip with a center hole is disposed below the film cone, the voice coil penetrates through the center holes of the film cone and the positioning support chip to tightly bond the center of the film cone and the center of the wavy positioning support chip to the outer wall of the voice coil, so that the vibration system of the loudspeaker is formed. However, the loudspeaker with such structure can only emit sound on one side of the film cone.

SUMMARY

The present disclosure provides a loudspeaker and an audio video device, so as to solve the problems of a relatively high thickness of the loudspeaker and emitting sound at only one side of the film cone in the related art.

The present disclosure provides a loudspeaker, and the loudspeaker includes a loudspeaker box and a drive unit.

The loudspeaker box includes a middle frame, a first diaphragm and a second diaphragm, where the first diaphragm and the second diaphragm are disposed at two ends of the middle frame respectively, and the first diaphragm, and the first diaphragm, the middle frame and the second diaphragm enclose a sound cavity.

The drive unit is disposed in the sound cavity and includes a U-iron, a magnet disposed on the U-iron, a magnetic conductive plate disposed on the magnet, and a voice coil sleeved on the magnet and the magnetic conductive plate, where the magnetic conductive plate and the U-iron are respectively positioned on two opposite sides of the magnet. The U-iron is disposed on the first diaphragm, and the voice coil is disposed on the second diaphragm.

As a preferred technical solution of the loudspeaker, the first diaphragm includes a first outer film layer and a first inner film layer. The first inner film layer is attached to the first outer film layer, the first outer film layer is connected to the middle frame, and the U-iron is disposed on the first inner film layer.

As a preferred technical solution of the loudspeaker, the first outer film layer is made of an elastic material, the first inner film layer is made of a hard material, and the first inner film layer is sheet-shaped.

As a preferred technical solution of the loudspeaker, the second diaphragm includes a second outer film layer and a second inner film layer. The second inner film layer is attached to the second outer film layer, the second outer film layer is connected to the middle frame, and the voice coil is disposed on the second inner film layer.

As a preferred technical solution of the loudspeaker, the second outer film layer is made of an elastic material, the second inner film layer is made of a hard material, and the second inner film layer is sheet-shaped.

As a preferred technical solution of the loudspeaker, the loudspeaker includes a plurality of drive units, the plurality of drive units are disposed in the loudspeaker box, and the plurality of drive units are disposed with spacings.

As a preferred technical solution of the loudspeaker, the U-iron is adhered to the first diaphragm, and the voice coil is adhered to the second diaphragm.

As a preferred technical solution of the loudspeaker, a weight of the voice coil is less than a total weight of the U-iron, the magnet and the magnetic conductive plate.

As a preferred technical solution of the loudspeaker, the middle frame comprises a first frame and a second frame, an annular groove is disposed on an end surface of one of the first frame and the second frame, an annular flange is disposed on an end surface of the other one of the first frame and the second frame, the flange is inserted into the groove, the first diaphragm is disposed on the first frame, and the second diaphragm is disposed on the second frame.

On the other hand, the present disclosure provides an audio video device comprising a loudspeaker in any of the solutions described above.

REFERENCE LIST

Figure 1:
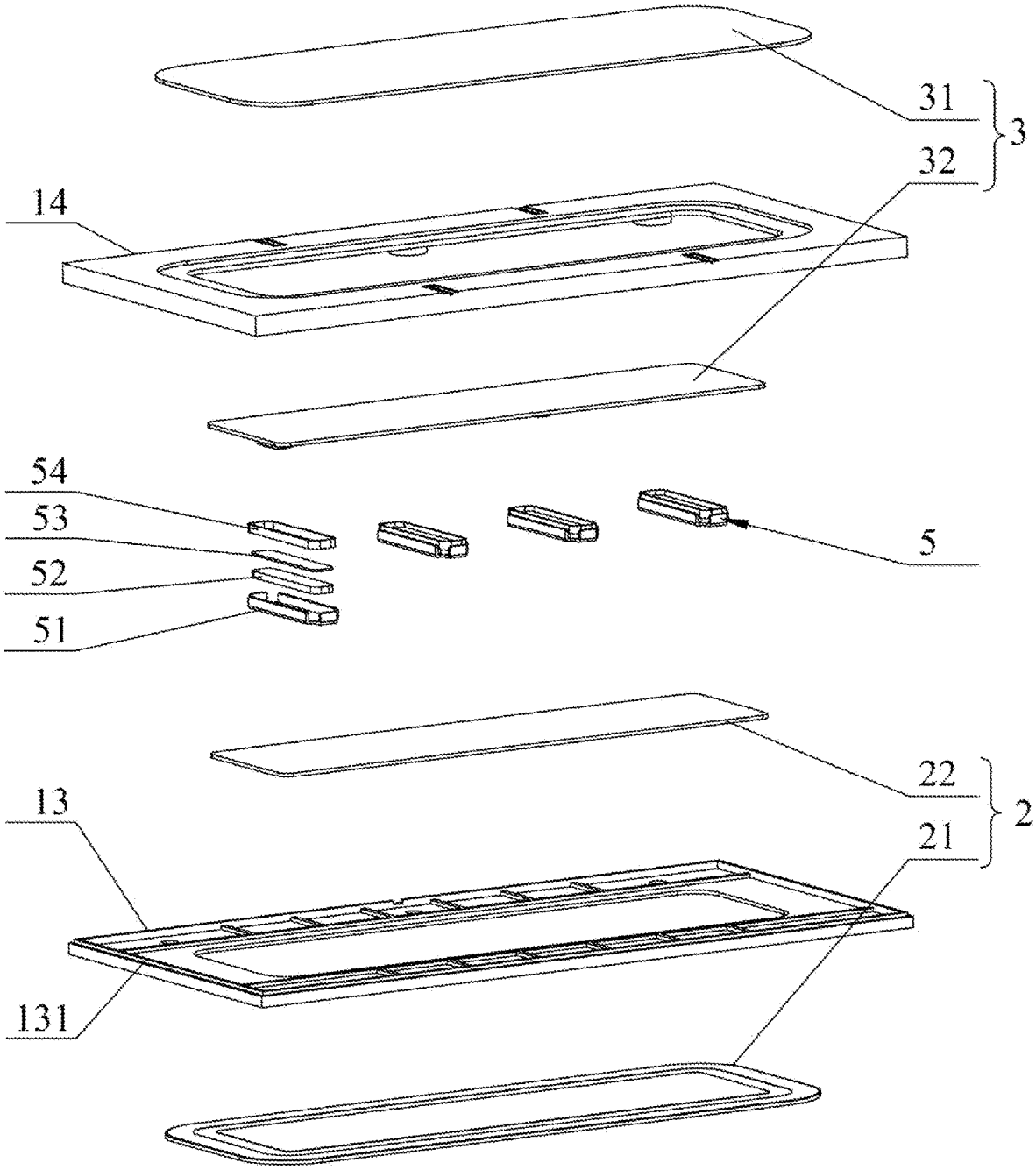
FIG. 1 is an exploded view of a loudspeaker provided by an embodiment of the present disclosure.

1 middle frame
11 through hole
12 opening
13 first frame
131 flange
14 second frame
2 first diaphragm
21 first outer film layer
22 first inner film layer
3 second diaphragm
31 second outer film layer
32 second inner film layer
4 sound cavity
5 drive unit
51 U-iron
52 magnet
53 magnetic conductive plate
54 Voice coil

DETAILED DESCRIPTION

The solutions of the present disclosure are to be clearly and completely described below with reference to the accompanying drawings.

In the description of the disclosure, it is to be noted that, the terms "Center", "Upper", "Lower", "Left", "Right", "Vertical", "Horizontal", "Inner", "Outer" and the like based on the orientation or positional relationship shown in the Figures are only to facilitate describing the disclosure and to simplify description, rather than indicating or implying that the device or elements must have a particular orientation, or be constructed and operated in a particular orientation, which therefore cannot be construed as limitations of the disclosure. Moreover, the terms "First", "Second" and the like are used for descriptive purposes only, which shall not be construed as indicating or implying relative importance. The terms "first position" and "second position" are two different positions. Besides, "on", "above" or "upper" indicates that the first feature is directly or obliquely above the second feature, or simply indicating that the first feature is higher in level than the second feature. "Under" "below" or "lower" indicates that the first feature is directly or obliquely below the second feature, or simply indicating that the first feature is lower than the second feature.

In the description of the present disclosure, it is to be noted that the terms "installed", "joined" and "connected" should be interpreted broadly unless expressly specified and defined otherwise, such as fixed connection, detachable connection, or integral connection; either mechanical connection or electrical connection; direct connection, indirect connection through intermediate media, or internal connection of two components.

Embodiments of the present disclosure are described in detail below, and examples of the embodiments are illustrated in the accompanying drawings, where the same or similar reference numerals denote the same or similar elements or elements with the same or similar functions.

As shown in FIGS. 1-4, the present embodiments provide a loudspeaker. The loudspeaker includes a loudspeaker box and drive units 5. The loudspeaker box includes a middle frame 1, a first diaphragm 2 and a second diaphragm 3. The first diaphragm 2 and the second diaphragm 3 are respectively disposed at the two ends of the middle frame 1. The first diaphragm 2, the second diaphragm 3 and the middle frame 1 enclose a sound cavity 4, and the drive unit 5 comprises a U-iron 51, a magnet 52, a magnetic conductive plate 53 and a voice coil 54. The magnet 52 is disposed on the U-iron 51, the magnetic conductive plate 53 is disposed on the magnet 52, the voice coil 54 is sleeved on the magnet 52 and the magnetic conductive plate 53. Specifically, the U-iron 51 has a U-shaped installation cavity, the magnet 52 is located in the installation cavity and is attached to a bottom wall of the installation cavity with glue, and the magnetic conductive plate 53 is attached to the magnet 52 with glue. The U-iron 51 is disposed on the first diaphragm 2, and the voice coil 54 is disposed on the second diaphragm 3.

In the loudspeaker, after the voice coil 54 is energized, the voice coil 54 generates an electromagnetic field, and under the action of the electromagnetic field and a magnetic field of the magnet 52, the voice coil 54 and the magnet 52 repel or attract each other, so that the U-iron 51 drives the first diaphragm 2 to vibrate and emit sound, and the voice coil 54 drives the second diaphragm 3 to vibrate and emit sound.

Figure 2:
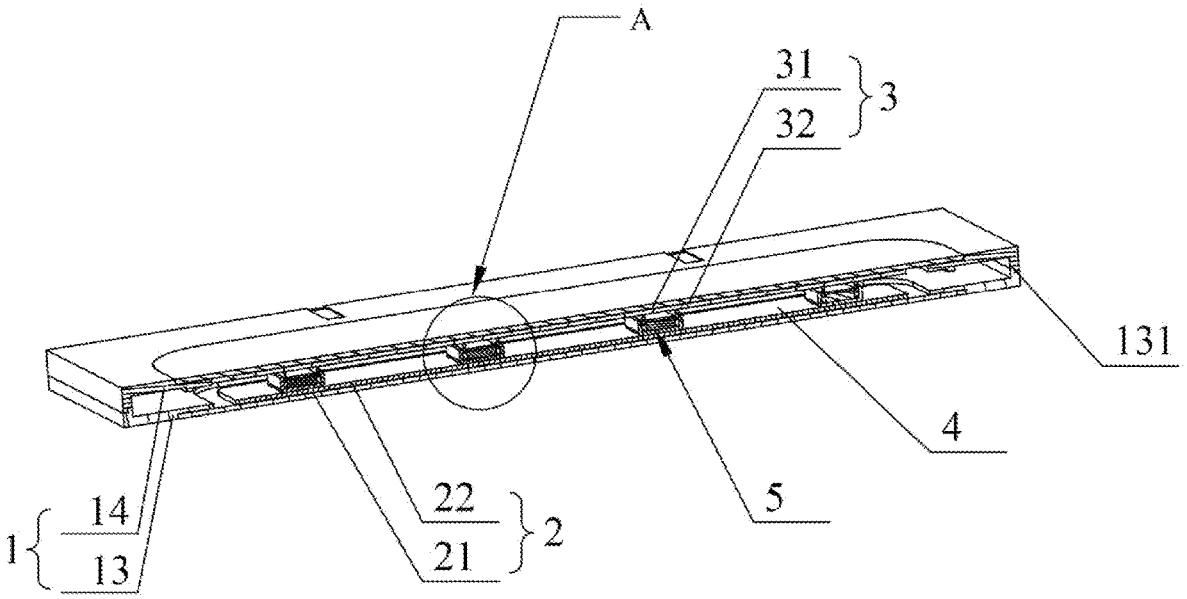
FIG. 2 is a cross-sectional view of the loudspeaker provided by an embodiment of the present disclosure.
Figure 3:
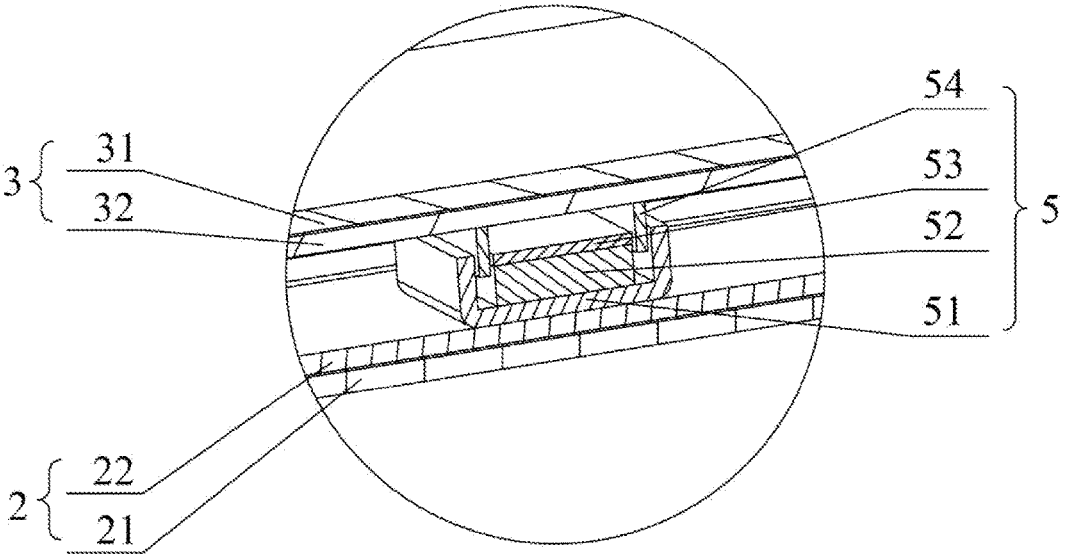
FIG. 3 is a partial enlarged view at A of FIG. 2.
Figure 4:
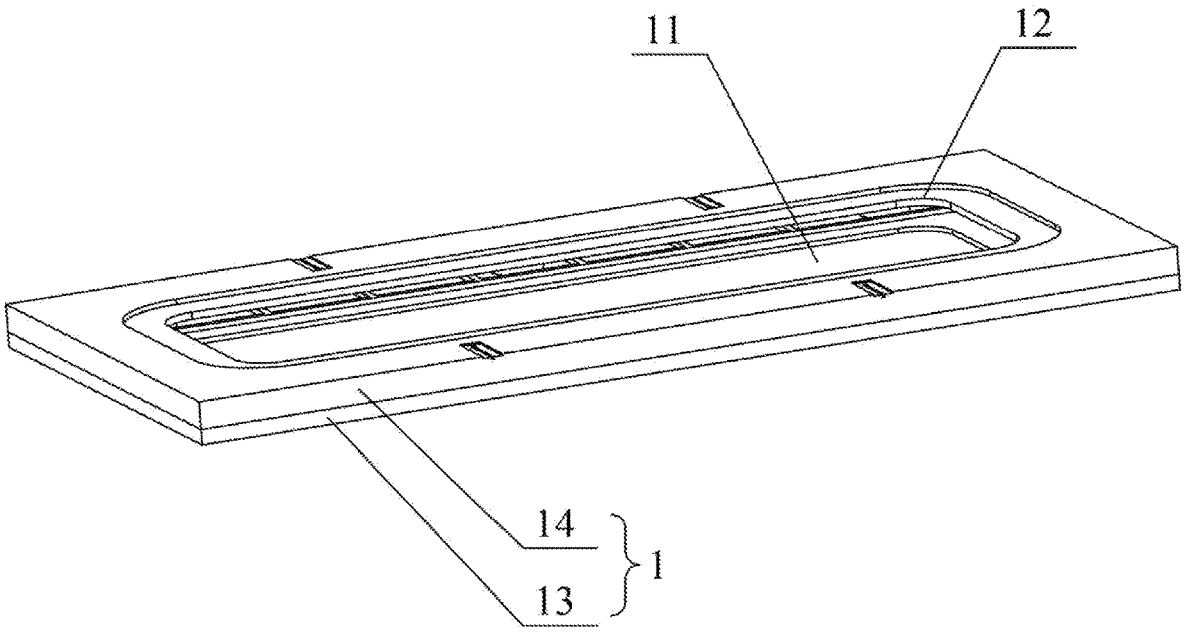
FIG. 4 is a schematic structure view of a middle frame provided by an embodiment of the present disclosure.

As shown in FIG. 2, in an embodiment, a through hole 11 is disposed in the middle frame 1, and the first diaphragm 2 and the second diaphragm 3 are respectively disposed at two ends of the through hole 11 to close openings 12 at two ends of the through hole 11, so that the sound cavity 4 is enclosed.

Optionally, the first diaphragm 2 includes a first outer film layer 21 and a first inner film layer 22. The first inner film layer 22 is attached to the first outer film layer 21, the first outer film layer 21 is connected to the middle frame 1, and the U-iron 51 is disposed on the first inner film layer 22. The second diaphragm 3 includes a second outer film layer 31 and a second inner film layer 32. The second inner film layer 32 is attached to the second outer film layer 31, the second outer film layer 31 is connected to the middle frame 1, and the voice coil 54 is disposed on the second inner film layer 32. Preferably, the first outer film layer 21 is made of an elastic material, the first inner film layer 22 is made of a hard material, and the first inner film layer 22 is sheet-shaped. The second outer film layer 31 is made of an elastic material, the second inner film layer 32 is made of a hard material, and the second inner film layer 32 is sheet-shaped.

When the U-iron 51 moves, the first inner film layer 22 is driven by the U-iron 51 to vibrate and send sound, and the first outer film layer 21 is used for ensuring vibration elasticity. When the voice coil 54 moves, the second inner film layer 32 driven by the voice coil 54 to vibrate, and the second outer film layer 31 is used for ensuring vibration elasticity. Specifically, the first outer film layer 21 and the second outer film layer are respectively located at two opposite ends of the through hole 11. The peripheral edge of the first outer film layer 21 is adhered to an end surface at one side of the middle frame 1 with glue to close the opening 12 at one end of the through hole 11, and a peripheral edge of the second outer film layer 31 is adhered to an end surface at the other side of the middle frame 1 with glue to close the opening 12 at the other end of the through hole 11. The first inner film layer 22 is adhered to the middle position of the first outer film layer 21 with glue, and the second inner film layer 32 is adhered to the middle position of the second outer film layer 31 with glue. In addition, the first inner film layer 22 is located in the sound cavity 4 without contacting with the middle frame 1, and the second inner film layer 32 is located in the sound cavity 4 without contacting with the middle frame 1.

In an embodiment, the first outer film layer 21 and the second outer film layer 31 may each be made of an aluminum sheet, a plastic sheet made of ABS or PC, a bakelite sheet, a wood board, a cardboard, a carbon fiber board, a PMI foaming board, or the like. The first inner film layer 22 and the second inner film layer 32 may each made of silica gel, frothed foam or the like.

Optionally, the loudspeaker includes a plurality of drive units 5, the plurality of drive units 5 are disposed in the loudspeaker box, and the plurality of drive units 5 are disposed with spacings. The plurality of drive units 5 may be set based on the requirements of the audio video device to which the loudspeaker is applied. Preferably, the plurality of drive units 5 are disposed in a rectangular array.

Optionally, the weight of the voice coil 54 is less than the total weight of the U-iron 51, the magnet 52, and the magnetic conductive plate 53. The second inner film layer 32 connected to the voice coil 54 is driven by the voice coil 54 to actively emit midrange and treble sound, while the U-iron 51 drives the first inner film layer 22 to passively emit bass sound under the action of the voice coil 54.

Optionally, the middle frame 1 includes a first frame 13 and a second frame 14. An annular groove is disposed at an end surface of one of the first frame 13 and the second frame 14, an annular flange 131 is disposed on an end surface of the other one of the first frame 13 and the second frame 14, and the flange 131 is inserted into the groove. The first diaphragm 2 is disposed on the first frame 13, and the second diaphragm 3 is disposed on the second frame 14. In this way, the middle frame 1 is provided in a split way, which facilitates assembly and maintenance of the middle frame 1. In this embodiment, a flange 131 is exemplarily disposed on the first frame 13 and a groove is disposed on the second frame 14.

An embodiment of the present disclosure also provides an audio video device, which comprises the loudspeaker above.

The beneficial effects of the present disclosure are as follows: provided are a loudspeaker and an audio-visual device. The loudspeaker includes a loudspeaker box and a drive unit. The loudspeaker box includes a middle frame, a first diaphragm and a second diaphragm. The first diaphragm and the second diaphragm are respectively disposed at the two ends of the middle frame, the first diaphragm, the second diaphragm and the middle frame are enclosed to form a sound cavity. The drive unit is disposed in the sound cavity. The drive unit comprises a U-iron, a magnet, a magnetic conductive plate and a voice coil. The magnet is disposed on the U-iron, the magnetic conductive plate is disposed on the magnet, and the voice coil is sleeved on the magnet and the magnetic conductive plate. The U-iron is disposed on the first diaphragm, and the voice coil is disposed on the second diaphragm. In the loudspeaker, after the voice coil is energized, the voice coil generates an electromagnetic field, and under the action of the electromagnetic field and a magnetic field of the magnet, the voice coil and the magnet repel or attract each other, so that the U-iron drives the first diaphragm to vibrate and emit sound, the voice coil drives the second diaphragm to vibrate and emit sound, so that bilateral sound emitting is achieved.

Apparently, the foregoing embodiments of the present disclosure are merely examples for clearly explaining the present disclosure, and are not intended to limit the embodiments of the present disclosure. For those of ordinary skill in the art, other different forms of changes or modifications can be made on the basis of the above description. There is no need and no way to enumerate all implementations. Any modification, equivalent substitution and improvement made within the spirit and principle of the present disclosure shall be included in the scope of the present disclosure.

What is claimed is:

1. A loudspeaker, comprising:

a loudspeaker box, which comprises a middle frame, a first diaphragm and a second diaphragm, wherein the first diaphragm and the second diaphragm are disposed at two ends of the middle frame respectively, and the first diaphragm, the middle frame and the second diaphragm enclose a sound cavity; and a drive unit, which is disposed in the sound cavity and comprises a U-iron, a magnet disposed on the U-iron, a magnetic conductive plate disposed on the magnet, and a voice coil sleeved on the magnet and the magnetic conductive plate; wherein the magnetic conductive plate and the U-iron are respectively positioned on two opposite sides of the magnet, the U-iron is disposed on the first diaphragm, and the voice coil is disposed on the second diaphragm, wherein a weight of the voice coil is less than a total weight of the U-iron, the magnet and the magnetic conductive plate.

2. The loudspeaker of claim 1, wherein the first diaphragm comprises a first outer film layer and a first inner film layer, the first inner film layer is attached to the first outer film layer, the first outer film layer is connected to the middle frame, and the U-iron is disposed on the first inner film layer.

3. The loudspeaker of claim 2, wherein the first outer film layer is made of an elastic material, the first inner film layer is made of a hard material, and the first inner film layer is sheet-shaped.

4. The loudspeaker of claim 3 wherein the loudspeaker comprises a plurality of drive units, the plurality of drive units are disposed in the loudspeaker box, and the plurality of drive units are disposed with spacings.

5. The loudspeaker of claim 3, wherein the U-iron is adhered to the first diaphragm, and the voice coil is adhered to the second diaphragm.

6. The loudspeaker of claim 2 wherein the loudspeaker comprises a plurality of drive units, the plurality of drive units are disposed in the loudspeaker box, and the plurality of drive units are disposed with spacings.

7. The loudspeaker of claim 2, wherein the U-iron is adhered to the first diaphragm, and the voice coil is adhered to the second diaphragm.

8. The loudspeaker of claim 1, wherein the second diaphragm comprises a second outer film layer and a second inner film layer, the second inner film layer is attached to the second outer film layer, the second outer film layer is connected to the middle frame, and the voice coil is disposed on the second inner film layer.

9. The loudspeaker of claim 8, wherein the second outer film layer is made of an elastic material, the second inner film layer is made of a hard material, and the second inner film layer is sheet-shaped.

10. The loudspeaker of claim 9 wherein the loudspeaker comprises a plurality of drive units, the plurality of drive units are disposed in the loudspeaker box, and the plurality of drive units are disposed with spacings.

11. The loudspeaker of claim 9, wherein the U-iron is adhered to the first diaphragm, and the voice coil is adhered to the second diaphragm.

12. The loudspeaker of claim 8 wherein the loudspeaker comprises a plurality of drive units, the plurality of drive units are disposed in the loudspeaker box, and the plurality of drive units are disposed with spacings.

13. The loudspeaker of claim 8, wherein the U-iron is adhered to the first diaphragm, and the voice coil is adhered to the second diaphragm.

14. The loudspeaker of claim 1 wherein the loudspeaker comprises a plurality of drive units, the plurality of drive units are disposed in the loudspeaker box, and the plurality of drive units are disposed with spacings.

15. The loudspeaker of claim 1, wherein the U-iron is adhered to the first diaphragm, and the voice coil is adhered to the second diaphragm.

16. The loudspeaker of claim 1, wherein the middle frame comprises a first frame and a second frame, an annular groove is disposed on an end surface of one of the first frame and the second frame, an annular flange is disposed on an end surface of the other one of the first frame and the second frame, the flange is inserted into the groove, the first diaphragm is arranged on the first frame, and the second diaphragm is arranged on the second frame.

17. An audio video device, applied to at least one of a mobile phone, a tablet, a television or a notebook computer and comprising a loudspeaker, wherein the loudspeaker comprises:

a loudspeaker box, which comprises a middle frame, a first diaphragm and a second diaphragm, wherein the first diaphragm and the second diaphragm are disposed at two ends of the middle frame respectively, and the first diaphragm, the middle frame and the second diaphragm enclose a sound cavity; and a drive unit, which is disposed in the sound cavity and comprises a U-iron, a magnet disposed on the U-iron, a magnetic conductive plate disposed on the magnet, and a voice coil sleeved on the magnet and the magnetic conductive plate; wherein the magnetic conductive plate and the U-iron are respectively positioned on two opposite sides of the magnet, the U-iron is disposed on the first diaphragm, and the voice coil is disposed on the second diaphragm, wherein a weight of the voice coil is less than a total weight of the U-iron, the magnet and the magnetic conductive plate.

* * * * *